US007918339B2

(12) United States Patent
Kashiwabara

(10) Patent No.: US 7,918,339 B2
(45) Date of Patent: Apr. 5, 2011

(54) PACKING IMPLEMENT FOR GOODS TRANSPORTATION

(75) Inventor: Kouichi Kashiwabara, Tokyo (JP)

(73) Assignee: Yamato Packing Technology Institute Co., Ltd., Tokyo (JP)

( * ) Notice: Subject to any disclaimer, the term of this patent is extended or adjusted under 35 U.S.C. 154(b) by 0 days.

(21) Appl. No.: 12/449,926

(22) PCT Filed: Mar. 23, 2007

(86) PCT No.: PCT/JP2007/055972

§ 371 (c)(1),
(2), (4) Date: Sep. 3, 2009

(87) PCT Pub. No.: WO2008/126199

PCT Pub. Date: Oct. 23, 2008

(65) Prior Publication Data

US 2010/0000907 A1 Jan. 7, 2010

(51) Int. Cl.
*B65D 85/30* (2006.01)

(52) U.S. Cl. ..... 206/583; 206/594

(58) Field of Classification Search ..... 206/583, 206/591, 592, 594, 521, 497, 320, 305; 229/190, 229/186

See application file for complete search history.

(56) References Cited

U.S. PATENT DOCUMENTS

| | | | | |
|---|---|---|---|---|
| 3,531,043 | A * | 9/1970 | Carlsson et al. | 206/436 |
| 5,411,204 | A * | 5/1995 | DeMay | 229/114 |
| 5,503,324 | A * | 4/1996 | Bacchetti et al. | 229/112 |
| 5,678,695 | A * | 10/1997 | Ridgeway et al. | 206/583 |
| 5,975,307 | A * | 11/1999 | Harding et al. | 206/583 |
| 6,073,761 | A * | 6/2000 | Jones | 206/223 |
| 6,148,591 | A * | 11/2000 | Ridgeway et al. | 53/499 |
| 6,158,589 | A * | 12/2000 | Smith et al. | 206/466 |
| 6,311,843 | B1 * | 11/2001 | Smith et al. | 206/583 |
| 6,311,844 | B1 * | 11/2001 | Ridgeway et al. | 206/583 |
| 6,467,624 | B1 * | 10/2002 | Lofgren et al. | 206/583 |
| 6,675,973 | B1 * | 1/2004 | McDonald et al. | 206/583 |
| 6,942,101 | B2 * | 9/2005 | Lofgren et al. | 206/583 |
| 2004/0084349 | A1 * | 5/2004 | Kari | 206/583 |
| 2004/0188309 | A1 * | 9/2004 | Kudou et al. | 206/521 |
| 2006/0213803 | A1 * | 9/2006 | Saitou et al. | 206/583 |
| 2007/0080095 | A1 * | 4/2007 | McDonald et al. | 206/583 |

FOREIGN PATENT DOCUMENTS

| | | | |
|---|---|---|---|
| JP | S56-43753 | U | 4/1981 |
| JP | S56-43755 | U | 4/1981 |
| JP | 2004-276957 | A | 10/2004 |

* cited by examiner

*Primary Examiner* — David T Fidei
(74) *Attorney, Agent, or Firm* — Manabu Kanesaka

(57) ABSTRACT

To provide a packing implement for goods transportation that facilitates packing of an article to be transported, and has a baseboard 6 and a holding sheet 7. The baseboard 6 is a board for supporting an article 1 at a fixed position, has upward and downward fold-back parts at both ends and both side parts, and is formed, at a junction point where lines for bend marked for folding back join, with a polygonal opening 15 having its vertices at the positions of lines for bend. The opening 15 serves as a starting point when folding back to prevent the fold-back parts from deviating from preset lines for bend, and after folding back, eliminates pointing of a part projected to the side to prevent an outer casing 3 from damage. The holding sheet 7 is tensed by bend of the baseboard 6 to press the article 1 to the baseboard 6, prevents the article 1 from slipping and holds it at the fixed position.

7 Claims, 11 Drawing Sheets

(a)

(b)

(c)

(d)

(a)

(b)

(c)

(a)

(b)

(a)

(b)

PACKING IMPLEMENT FOR GOODS TRANSPORTATION

TECHNICAL FIELD

The present invention relates to a packing implement for goods transportation for housing and transporting various goods such as notebook computers, more particularly, it relates to a packing implement for goods transportation suitable for home delivery services.

BACKGROUND ART

There has been a dramatic increase in the need for transportation of notebook computers with the spread of notebook computers. A case has been seen recently where a request for repair, memory extension or the like of a notebook computer from a user is received by a maker's repair center only with mail service or home delivery service rather than direct carrying in by a user.

In this case, the notebook computer sent from the user to the maker and repaired or maintained is also sent back from the maker to the user with the mail service or home delivery service. Packing of the notebook computer in transportation with the mail service or home delivery service is required to sufficiently protect the notebook computer from impacts.

In the transportation of the notebook computer, although it is conventionally possible for the maker in the transportation to the user to take a sufficient protection measure necessary for the packing or to standardize the packaging to a certain quality, it is not always easy for the user having no packing material to take the sufficient protection measure necessary for the packing unless an exclusive packing implement for notebook computer transportation is provided.

A packaging structure constituted by a combination of a baseboard and a flexible film is disclosed as a packing implement for goods transportation in, for example, U.S. Pat. No. 5,678,695. In the packaging structure, the flexible films which serve as a holding sheet 22 are stacked on a board surface of a rectangular baseboard 21 as shown in FIG. 11, and both edges of the holding sheet 22 are adhered to both ends of the baseboard. An article M to be housed is placed between the baseboard 21 and the holding sheet 22 as shown in FIG. 12, both side edge parts 24 of the baseboard 21, to which the holding sheet 22 is adhered, are folded back in a direction opposite a mounting surface of the article M along lines for bend 23 marked on the board surface of the baseboard 21 of both the sides of the article as shown in FIG. 13, and further both end parts 25 of the board surface of the baseboard 21 are respectively erected upward and the packaging structure is housed in an outer casing 26 for transportation as shown in FIG. 14.

In the packaging structure as shown in FIG. 11, both side edges of the baseboard 21 are folded back to the back side so that the flexible film employed as the holding sheet 22 is tensed, and then the article M can be stably supported in the outer casing 26 by being press-fitted to the flexible film and fixed to the board surface of the baseboard, however, as clearly shown in FIG. 14, the article M is simply mounted on an upper surface of the baseboard 21 that fold-back edges of both the side edge parts 24 are folded on a lower surface of the baseboard 21, and therefore, there remains a problem that impact force is directly applied to the article M through the baseboard 21 from the bottom of the outer casing 26 and which causes a high risk of damage to the article when the outer casing 26 in which the article is housed is erroneously dropped during transportation or other handling.

However, regarding the above problem, a proposal has been disclosed in U.S. Pat. No. 5,678,695 that folding end portions 27 are provided in the baseboard 21 as shown in FIG. 15 and erected at both sides of the article mounting surface of the baseboard 21 to form a buffer space below the article mounting surface as shown in FIG. 16. However, there arise problems that not only the pasteboard itself of the baseboard 21 becomes larger but also it takes a long time for assembly work by special parts as the folding end portions 27 provided in the baseboard 21.

Additionally, since the protection measure for the article M from an impact such as a drop wholly depends on only the tightening force of the press of the holding sheet 22, the article reaches the side edge or end edge of the baseboard 21 while slipping on the board surface of the baseboard 21 against the tightening force of the holding sheet 22 when an article such as a notebook computer, which is relatively thin and heavy, is housed in the packaging structure. Thus, there remains a risk that the impact applied to the outer casing is directly applied to the article M which is accommodated in an outer casing. In order to solve such problems, the inventors have previously proposed packing implements for goods transportation (1), (2) (U.S. Patent Publication No. US 2006/0213803 A1) for which no specific part is required to be applied, and a buffer space can be naturally formed below the baseboard by only a regular bend of a part of the baseboard to which a holding sheet is attached.

For the packing implement (1), as shown in FIG. 17, in short, an article 31 is placed between a baseboard 36 and a holding sheet 37, leg parts 39 of both falling parts 41 are squarely bent downward from end edges of the baseboard 36, then bottom parts 40 are horizontally bent, and rising parts 42 are folded back upward from both side edges of the baseboard 36 and assembled in a fixed form. As a result, both the falling parts 41 are held at a fixed position, a buffer space having a height corresponding to the leg part 39 is naturally formed between the baseboard 36 and the bottom part 40, and triangle parts 38 of both the ends of the leg part 39 continued to the rising parts 42 are projected to the sides so that buffer spaces are also formed at the sides of the packing implement.

In the packing implement (1), the rising parts 42 are formed by bending a flat board, and as an application thereof the packing implement (2) has been proposed in which casing bodies 49 are formed as shown in FIG. 18 at the rising parts 42, respectively. However, it has been discovered that in the case of the packing implement (1), points of the triangle parts 38 of both the ends of the leg part 39 continued to the rising parts 42 are sharply pointed as shown in FIG. 19(*a*), and particularly in the packing implement (2) as an application thereof where casing bodies 49 are formed at the rising parts 42, respectively, tips of the triangle parts 38 are projected to the sides to sharply thrust the inner walls of an outer casing 43 as shown in FIG. 19(*b*), and thus a problem that holes are opened in the outer casing occurs.

The rising parts 42 and the falling parts 41 are parts formed by dividing along lines for bend marked on the baseboard 36, and a description has been given of an example of providing a circular opening at a junction point of both lines for bend to form the leg part 39 for the purpose of facilitating bend of the rising part, however, in an actual case where the circular opening is provided, the falling parts 41 and the rising parts 42 may be bent deviating from appointed lines for bend when being bent along lines for bend marked on the baseboard for the first time.

Patent Document 1 U.S. Pat. No. 5,678,695

Patent Document 2 U.S. Patent. Publication No. US 2006/0213803 A1

DISCLOSURE OF THE INVENTION

Problem to be Solved by the Invention

The problem to be solved is that, when the falling parts are folded back downward and the rising parts are folded back upward, a problem occurs that tips of the triangle parts formed projecting to the sides of a packing implement thrust the inner walls of an outer casing to open holes in the outer casing.

Means for Solving the Problem

The main characteristic of the present invention is to prevent damage to the outer casing by the tips of the triangle parts projected to the sides, without losing the shape of an assembled packing implement.

Effects of the Invention

When an article is placed between the baseboard and the holding sheet of a packing implement, the leg parts of both falling parts are squarely bent downward from end edges of the baseboard, then the bottom parts are horizontally bent, and the rising parts are folded back upward from both side edges of the baseboard, the baseboard is assembled in a fixed form as a result of being accurately bent along the lines for bend with the openings used as starting ends, and a buffer space having a height corresponding to the leg part is naturally formed between the baseboard and the bottom part. Next, when the packing implement that has housed the article in the above procedures is accommodated in an outer casing, buffer spaces are naturally formed at both sides of the housed article, that is, between the leg parts and inner walls of the outer casing, and the triangle parts of both the ends of the leg part continued to the rising parts are absent at their tips to become flat surfaces, respectively, and thus never damage the inner surfaces of the outer casing.

DESCRIPTION OF REFERENCE SYMBOLS

Figure 1:
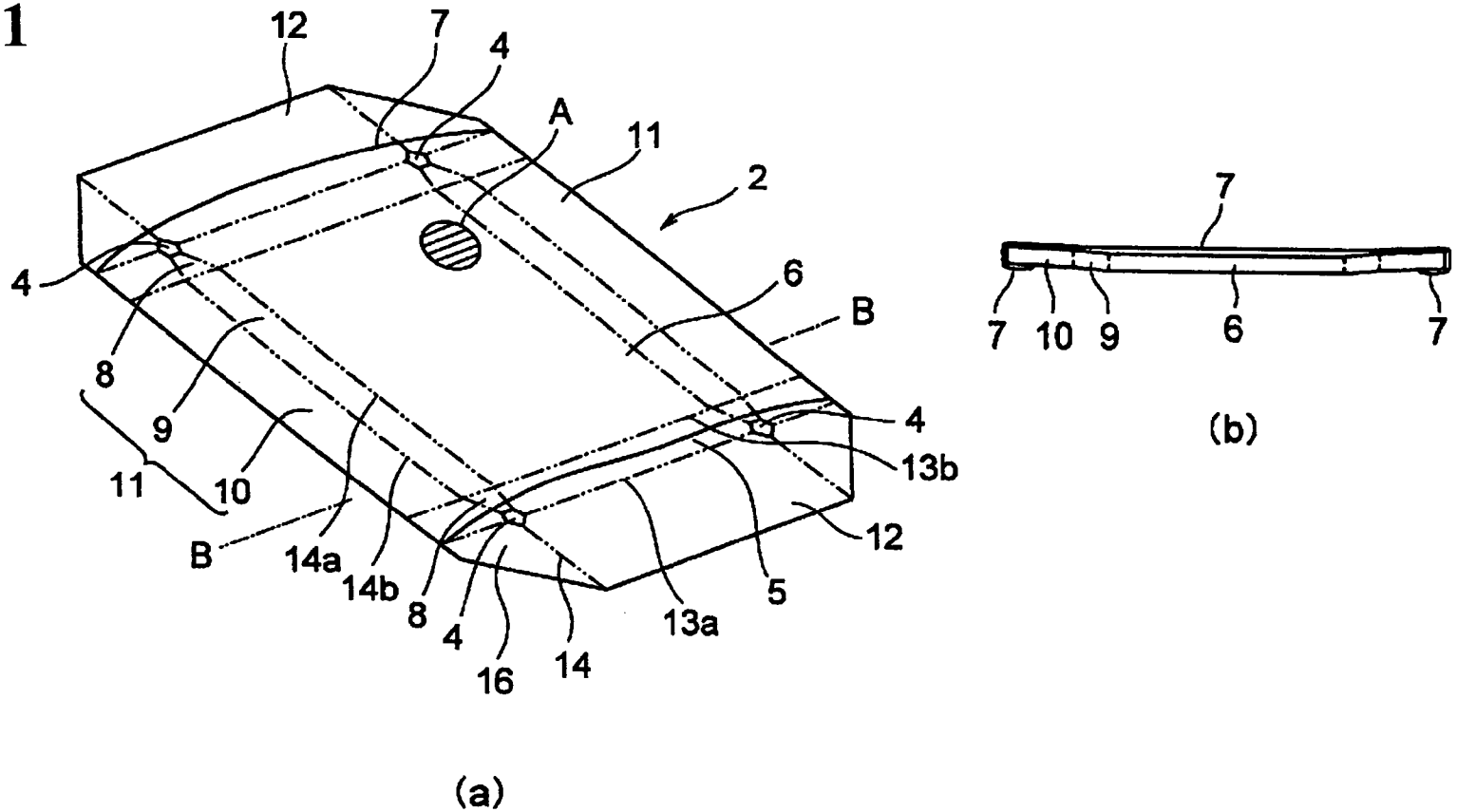
FIG. 1(*a*) is a developed view showing a packing implement of Embodiment 1 of the present invention, and FIG. 1(*b*) is a cross sectional view taken along line B-B in FIG. 1(*a*).

1 goods
2 packing implement
3 outer casing
4 polygonal opening
5 down tilting part
6 baseboard
7 holding sheet
8 triangle part
9 leg part
10 bottom part
11 falling part
12 rising part
13*a*, 13*b*, 13*c* line for bend
14, 14*a*, 14*b*, 14*c*, 14*d* line for bend
15 polygonal opening
16 shape-retaining part
17 slit
18 side wall of casing body
19 end surface of casing body

BEST MODES FOR CARRYING OUT THE INVENTION

The present invention has achieved the object of preventing the outer casing from damage by the point of a triangle, by forming, at a junction point of lines for bend forming a triangle part, a polygonal opening having its vertices at points where the lines for bend intersect.

Embodiment 1

A packing implement for goods transportation of the present invention packs goods to be accommodated in an outer casing, as an inner body which serves as a buffer material.

The packing implement of the present invention is made of corrugated paper, and the article which should be stored in this packing implement is, for example, a notebook computer, however, it is not limited to a flat article. Even if it is a tall article, storing is possible.

A packing implement 2 has a combination of a baseboard 6 and a holding sheet 7 as shown in FIG. 1, and is accommodated in the outer casing with holding the article 1 between the baseboard 6 and the holding sheet 7.

In FIGS. 1(*a*) and 1(*b*), the baseboard 6 of the packing implement 2 is a rectangular corrugated board of which an upper surface supports the article 1, and has fold-back parts. The fold-back parts are parts where both ends and both side parts of the baseboard are folded back upward and downward along lines for bend, respectively. The parts thus folded back are parts that are partially projected to the sides to form buffer spaces below and at the sides of the baseboard, respectively. In this embodiment, the baseboard 6 has, as the fold-back parts, falling parts 11, 11 at both left and right side edges of the board surface of the long side of the rectangle, and has rising parts 12, 12 at both front and rear end edges of the board surface of the short side thereof and shape retaining parts 16 at four corners of the baseboard 6.

The falling parts 11 and rising parts 12 are front parts of the side edge and end edge of the baseboard 6, respectively.

The falling part 11 includes a leg part 9 and a bottom part 10 of the front part thereof. The leg part 9 is a part to be made orthogonal to the board surface of the baseboard 6, and the bottom part 10 is a part for which the front part of the leg part 9 is bent to be arranged parallel with the baseboard 6. A center part of the leg part 9 has a constant width, both ends thereof are each converged to one point to be triangular, and a tip of an acute angle of the triangle part 8 is continued to the rising part 12.

In FIG. 1, the reference symbols 14*a* and 14*b* denote lines for bend which divide the bottom part 10 and the leg part 9, respectively, and the reference symbol 14 denotes a line for bend extending from a junction point of both the lines for bend 14*a* and 14*b* to an end edge of the rising part 12. The triangle parts 8 of both the ends of the leg part 9 are respectively formed by junction of the lines for bend 14*a* and 14*b*, and down tilting parts 5 projected to both sides are formed at base parts of the rising parts 12, respectively.

The down tilting parts 5 are parts divided by lines for bend 13*a*, 13*b* drawn inside and outside in parallel with a fixed interval therebetween at both end edges of the baseboard 6, and the rising parts 12 are front parts from the outer line for bend 13*a* to be folded back upward from the down tilting parts 5 formed at the both end edges of the baseboard 6.

The shape retaining parts 16 are four corner parts of the baseboard left between end edges of the rising parts 12 and end edges of the falling parts 11, respectively, are continued to the rising parts 12 and the falling parts 11, respectively, are folded back parallel with the rising parts 12 when the end edges of the falling parts 11 are bent to a lower surface side of the baseboard 6, respectively, and are erected to hold the falling parts bent when the rising parts 12 are folded back upward, respectively. In this embodiment, an outer end of the shape retaining part 16 is obliquely cut off, however, the shape thereof may be rectangular, and any shape of the shape retaining part 16 is applicable.

The line for bend 13*a* to form the rising part 12 is a linear line which passes a junction point of the lines for bend 14*a* and 14*b* that divide the triangle part 8 of the end of the leg part 9 and joins the line for bend 14 extending from the junction point of both the lines for bend 14*a* and 14*b* to an end edge of the rising part 12. The triangle part 8 of the end of the leg part 9 becomes a part projected to the side at a fixed angle when the falling part 11 is folded back downward from the baseboard 6 and the rising part 12 is folded back upward from the baseboard 6.

Figure 2:
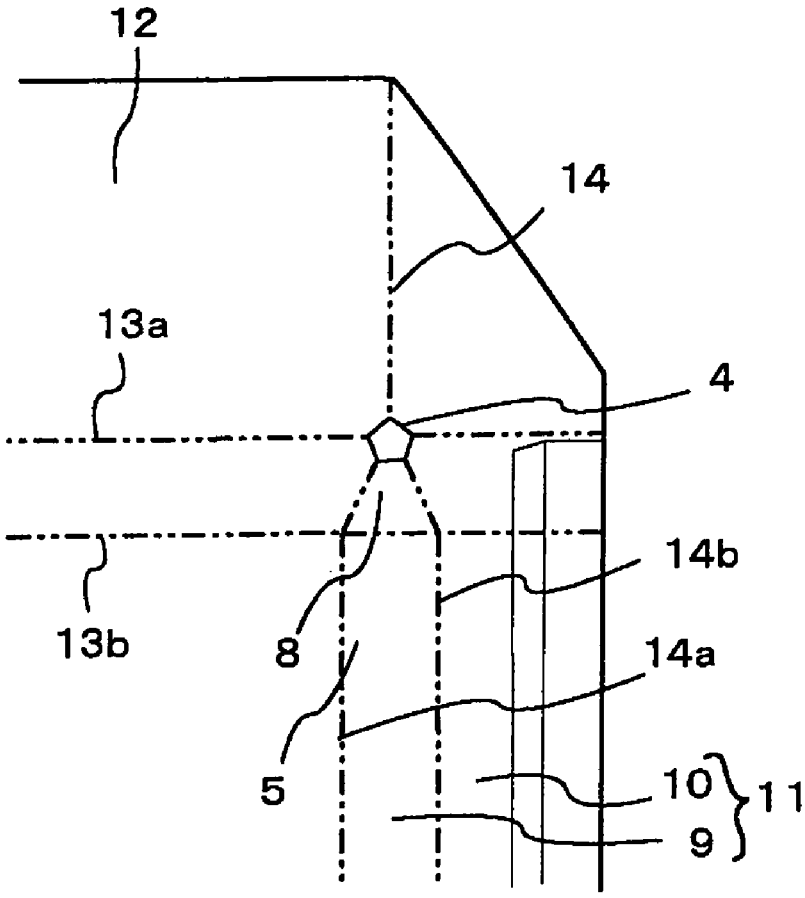
FIG. 2 is a view showing the shape of an opening opened at a junction point of lines for bend marked on a baseboard in Embodiment 1.

In the present invention, a polygonal opening 4 having its vertices at the positions of lines for bend is formed at a junction point where the lines for bend intersect. The opening 4 is therefore formed in this embodiment at a position where the four lines for bend 14*a*, 14*b*, 13*a*, and 13*b* join and the single line for bend 14 intersects as shown in FIG. 2, so that the opening shape is pentagonal. The opening 4 is, in short, for eliminating a pointed apex of the triangle part 8 of the end of the leg part 9, and it is thus sufficient to have such a size as to allow relieving contact against the outer casing. With an excessively large opening diameter, the length of projection of the triangle part 8 to the side is reduced as to be described later, which is not preferable.

Although the holding sheet 7, in this embodiment, as shown in FIG. 1(*b*), is folded back at both ends thereof to a back surface side of the baseboard 6 and fixed to the left and right side edges thereof (end edges of a back surface of the falling part), respectively, the holding sheet 7 is for pressing and fixing an article onto the baseboard 6, and thus in short, it suffices that both ends thereof are attached to the board surface of the baseboard 6 across the baseboard 6, and the position to attach the same is not always limited to that in the case of folding back to a back surface side of the baseboard 6 and fixing to the back surface thereof. When the holding sheet 7 is folded back to a back surface side of the baseboard 6 and attached to the back surface thereof, it is necessary to turn over the baseboard 6 in the attachment, however, the holding sheet 7 is attached to both side edges of the baseboard 6 to facilitate attaching work, so that the packing implement can be improved in productivity. Moreover, when fixing the holding sheet 7, besides adhering and fixing to a paper surface of the baseboard 6 by thermal welding fixation or an adhesive, this may be attached to the paper surface by attachment fixation etc., such as use of double-stick tape.

Moreover, for the holding sheet 7, it is desirable to provide the falling parts 11 at the long sides of the rectangular baseboard 6. Due to the falling parts 11 provided at the long sides of the rectangular baseboard 6, the length of the holding sheet 7 is sufficient if there is an even length necessary for covering the board surface of the narrow rectangular baseboard 6, and the stretch rate of the sheet is small and a strong pressing force can be obtained.

Moreover, a stretchable sheet is employed as the holding sheet 7 so that an impact or pressure such as flexibility or plasticity can be absorbed or avoided. A transparent film made of thermal plastic resin is desirable for the holding sheet 7 in terms of consideration for environment, recycling, sanitation, design characteristics or the like.

When an article to be housed is thin and heavy, there is a possibility that the article to which the impact is applied overcomes the pressing force of the holding sheet 7 to slip on the baseboard 6 and collide with a board surface of the rising part 12 at the side of the sheet 7. In order to avoid the above situation, it becomes necessary when using a film that the film has more than a certain strength and physical property irrespective of the quality, however, without limitation to a film, it is also possible to use a material formed of non-woven fabric, woven fabric, knit or the like.

Figure 3:
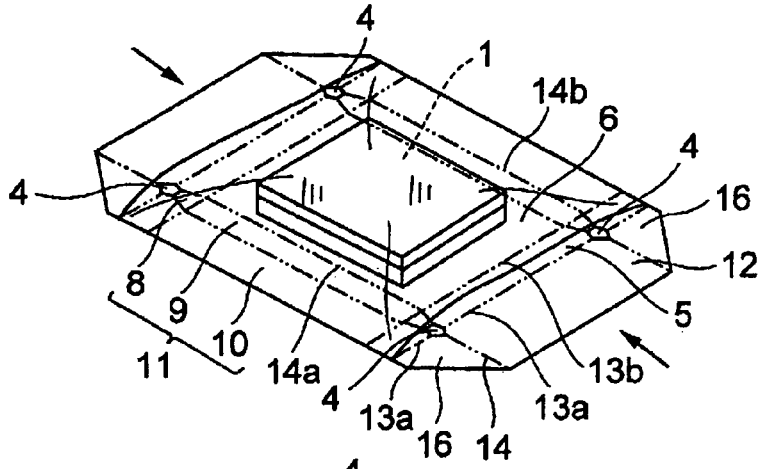
FIGS. 3(*a*), 3(*b*) and 3(*d*) are views showing procedures for packing an article with use of the packing implement of the present invention in order, and FIG. 3(*c*) is a cross sectional view taken along line C-C in FIG. 3(*b*).
Figure 3:
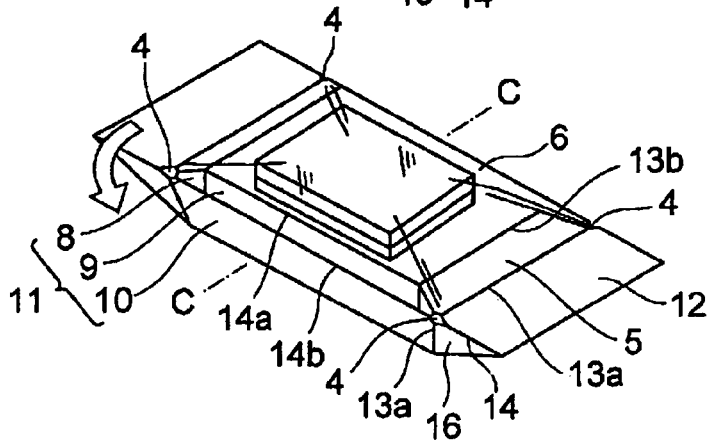
Figure 3:
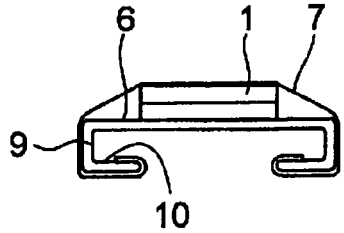
Figure 3:
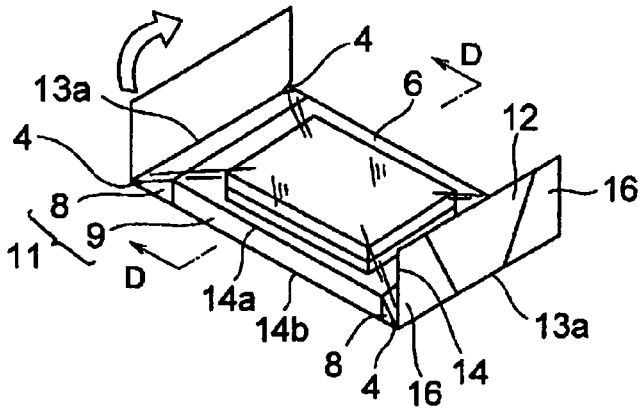

Next, procedures for packing the article with use of the packing implement of the present invention will be explained. In FIG. 3(*a*), both the falling parts 11 and 11 firstly are folded back slightly upward, a space between the baseboard 6 and the holding sheet 7 is opened and the article 1 is placed in the space between the baseboard 6 and the holding sheet 7 from a surface side of the rising part 12.

Next, as shown in FIG. 3(*b*), both the falling parts 11 are bent downward along the lines for bend 14*a* and 14*b* connecting both openings 4, 4 against the tension of the holding sheet 7. Thus, the leg part 9 of the falling part 11 is squarely bent to the baseboard 6 as shown in FIG. 3(*c*), the triangle parts 8 of both the ends of the leg part 9 are projected to the sides, respectively, and further, the bottom part 10 of the falling part 11 is bent parallel with the baseboard 6, and the shape retaining part 16 is stacked on the back surface of the rising part 12. Because the openings 4 are opened at the tips of the triangle parts 8 of both the ends of the leg part 9, the triangle parts 8 are absent at tip parts thereof, and projected to the sides in a flattened manner, respectively. The holding sheet 7 is pulled by the triangle parts 8 projected to both the sides outward, respectively, and the falling part 11 to be tensed and squarely bent at the leg part 9.

Figure 4:
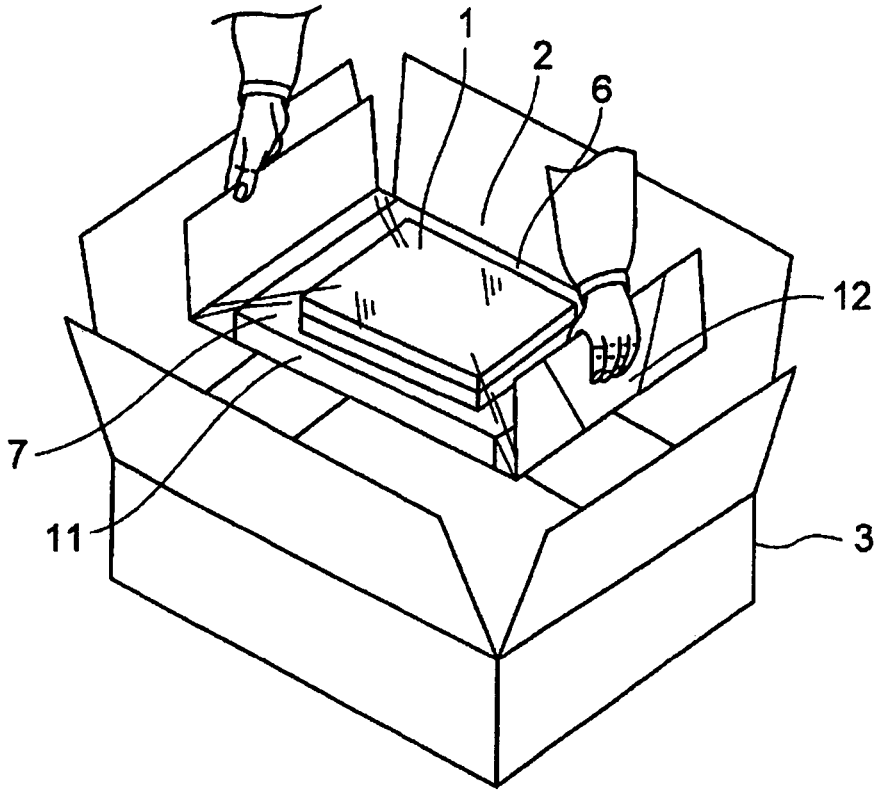
FIG. 4 is a view showing a procedure for housing the packing implement with the article packed in an outer casing.

Next, in FIG. 3(*d*), when the rising part 12 is folded back upward from the end edge of the baseboard 6 along the line for bend 13*a* connecting both openings 4, 4, due to the rising part 12 thus folded back, the shape retaining part 16 is erected integrated with the rising part 12 brought into contact with the outer surface of the rising part 12, the erectness of the shape retaining part 16 is kept as long as the rising part 12 is held by hands, the leg part 9 of the falling part 11 is kept square to the baseboard 6, and the bottom part 10 is kept parallel with the baseboard 6. The erectness of both the rising parts 12 and 12 is held, and thus the holding sheet 7 is bent at the down tilting part 5 of the base part of the rising part 12, squarely bent at the leg part 9 of the falling part 11 side to be tensed, press-fits the article 1, and holds the article 1 at the fixed position on the baseboard 6. The packing implement 2 packing the article is placed into the outer casing 3 in its entirety as shown in FIG. 4, the outer casing 3 is lidded and the packing-is completed.

In the present invention, when the baseboard 6 is bent and assembled into a packing implement, if the baseboard is bent along the lines for bend, the baseboard 6 is naturally bent along the lines for bend with the polygon vertices of the opening 4 used as the starting points particularly at the four corners where a plurality of lines for bend intersect, so that the baseboard can be accurately bent along regular lines for bend without deviating from the predetermined lines for bend, and can be reliably assembled into a regular shape with no deformation occurring in the assembled packing implement. The article 1 is housed in the outer casing 3 being supported by the packing implement 2. However, the rising part 12 and the falling part 11 of the packing implement 2 constituted by the bend of the end edge parts of the baseboard 6 possess recovery force, more particularly, a strong recovery force based on the tension of the holding sheet 7 is applied to the falling part 11, the falling part 11 is pressed to a lower bottom of the outer casing 3, and the rising part 12 is brought into press-contact with an upper bottom surface of the outer casing 3 by the recovery force of the holding sheet 7 applied to the falling part 11.

Figure 5:
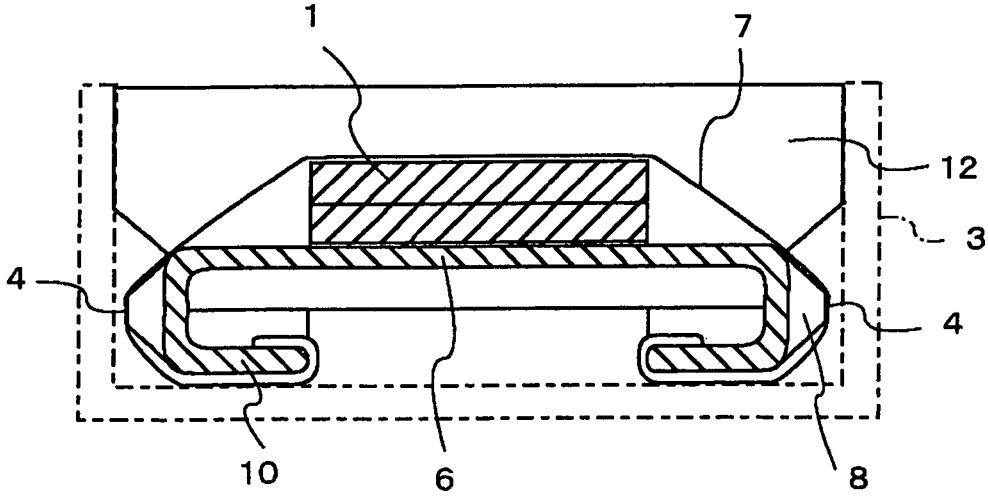
FIG. 5 shows a projecting state of the packing implement in the outer casing, which is a view of the packing implement viewed in the arrow direction from line D-D in FIG. 3(*d*).

Thus, the article 1 on the baseboard 6 is stably supported at the fixed position on the baseboard 6 by the pressing force of the holding sheet 7 being accommodated in the outer casing 3, and further, in the present invention, the buffer space corresponding to a rising height of the leg part 9 of the falling part 11 is formed at the lower surface of the baseboard 6, and the triangle parts 8 of both the ends of both the leg parts 9 are projected to the sides at the sides of the baseboard 6 respectively, however, the triangle parts 8 are absent at the front end parts thereof to have no tips as shown in FIG. 5 so that local stress never acts on an inner surface of the outer casing 3, and hence, the outer casing 3 is not damaged.

According to the present invention, the buffer spaces are also naturally formed above and below and at both sides of the article mounting surface of the baseboard 6, on which the article is mounted, and these buffer spaces can absorb the impact applied to the outer casing 3 to effectively protect the article 1 from damage. Furthermore, when the holding sheet 7 ensures more than a certain strength, the article is stably held at the fixed position on the baseboard 6 without slipping and an influence of an impact from the outside can be eliminated even if the housed article is thin and heavy and receives the impact from the side of the outer casing 3.

Moreover, in FIG. 1, a direction of a line inside of a circle indicated by the reference symbol A shows a direction of a flute of the corrugated paper. The corrugated paper is bent with a relatively small force in the direction along the flute, but needs a relatively large force in order to be bent in a direction orthogonal to the flute.

Figure 6:
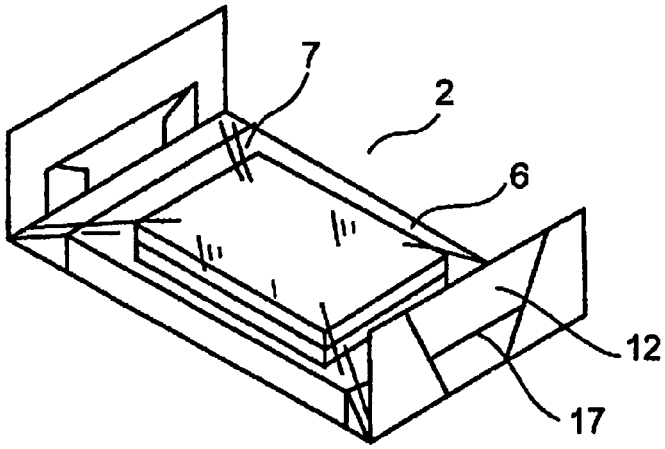
FIG. 6 is a view showing an example that a slit is opened in a rising part.

In the present invention, when an oblong slit 17 is opened in the rising part as shown in FIG. 6, the opening can be used as a handle for holding of the packing implement 2. Additionally, when an end of the holding sheet 7 is folded back on an outer surface of one of the rising parts 12 and 12 through the slit 17 and the fold-back end is fixed to the rising part 12, each three sides of the holding sheet 7 and the baseboard 6 are closed, and therefore the article can be further reliably prevented from dropping out. Further, when the end of the holding sheet 7 is fixed to the outer surface of one of the rising part 12 through the slit 17 and another end of the holding sheet 7 is attachably or detachably fixed to another opposite rising part 12, four sides of the holding sheet 7 can also be fixed after the article is packed.

Embodiment 2

Figure 7:
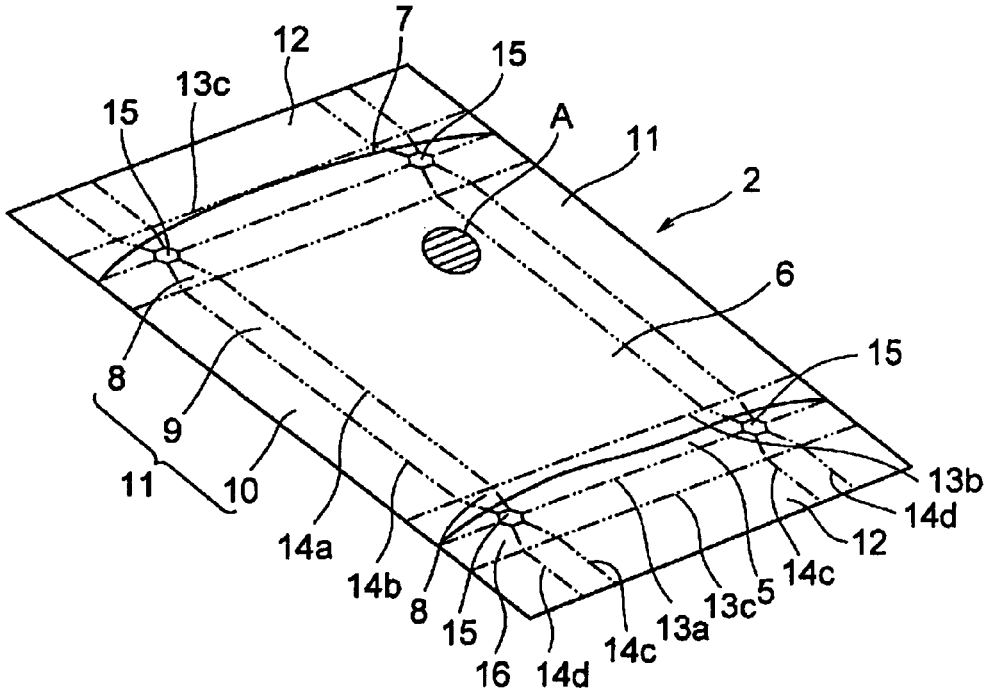
FIG. 7 is a developed view of a packing implement of Embodiment 2.
Figure 8:
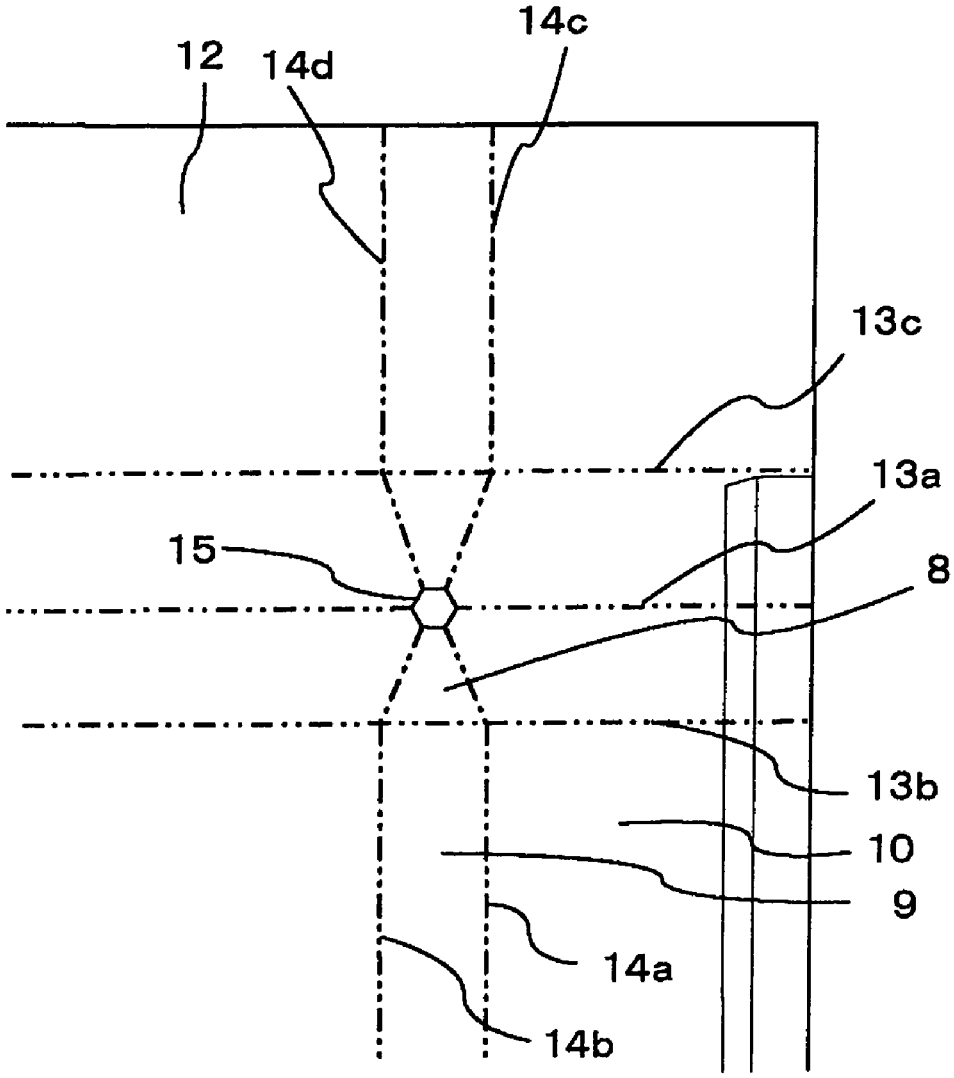
FIG. 8 is a view showing the shape of an opening opened at a junction point of lines for bend marked on a baseboard in Embodiment 2.

FIG. 7 shows an example where the shape retaining parts 16 in Embodiment 1 are used for casing bodies (or forms) of which upper surfaces are opened. In FIG. 7, lines for bend 14*c* and 14*d* are marked on the rising part 12, the lines for bend 14*c* and 14*d* extending from a junction point of lines for bend 14*a*, 14*b*, which divide the bottom part 10 and the leg part 9, respectively, to end edges of the rising part 12 and the shape retaining part 16 are symmetrical to the lines for bend 14*a* and 14*b*, and the rising part 12 is further marked with the above-mentioned two lines for bend 13*a*, 13*b* and a third line for bend 13*c* outside these lines. Accordingly, in this embodiment, the junction point of the lines for bend 14*a* and 14*b* that divide the triangle part 8 of the end of the above-mentioned leg part 9 is joined with the two lines for bend 14*c*, 14*d* extending from the opposite side as shown in FIG. 8, and a polygonal opening 15 having its vertices at the lines for bend is formed at that junction point. The opening 15 is therefore formed in this embodiment at a position where the four lines for bend 14*a*, 14*b*, 14*c*, and 14*d* join and the single line for bend 13*a* intersects, so that the opening shape is hexagonal.

Figure 9:
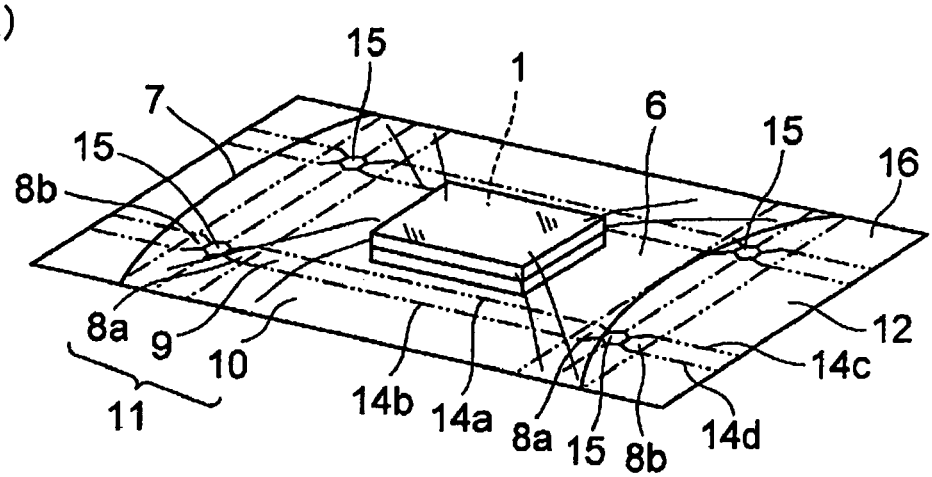
FIGS. 9(*a*) to 9(*c*) are views showing procedures for packing an article with use of the packing implement of Embodiment 2 in order.
Figure 9:
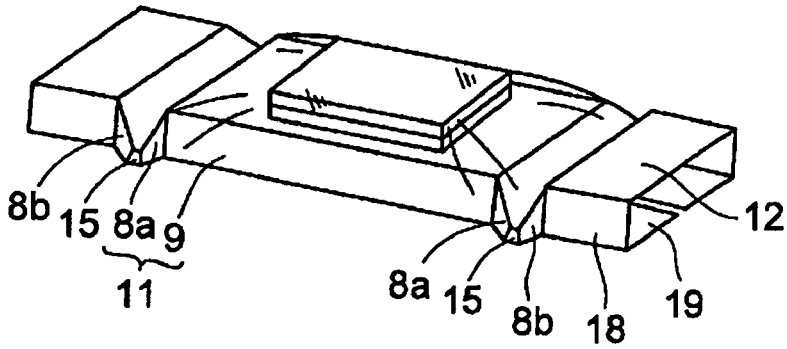
Figure 9:
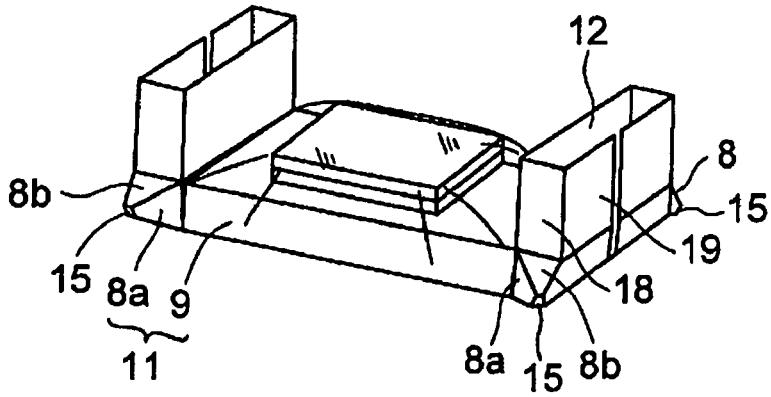

When packing an article with use of the packing implement of this embodiment, in FIG. 9(*a*), the article 1 is placed between the baseboard 6 and the holding sheet 7 by the same operation as in the previous embodiment. Then, while the leg part 9 and the bottom part 10 are respectively formed by bending along the lines for bend 14*a* and 14*b*, the rising part 12 and the shape retaining part 16 are respectively bent along the lines for bend 14*c* and 14*d* to form a side wall 18 and an end surface 19 of the casing body, and then the rising parts 12 are erected as shown in FIG. 9(*b*), the casing bodies, of which each upper surface is opened, are formed at both ends of the packing implement respectively, triangle parts 8*a* projected to the sides are formed at both ends of the leg part 9, respectively, and triangle parts 8*b* projected to the sides are formed at both side edges of the rising part 12, respectively, as shown in FIG. 9(*c*).

Figure 10:
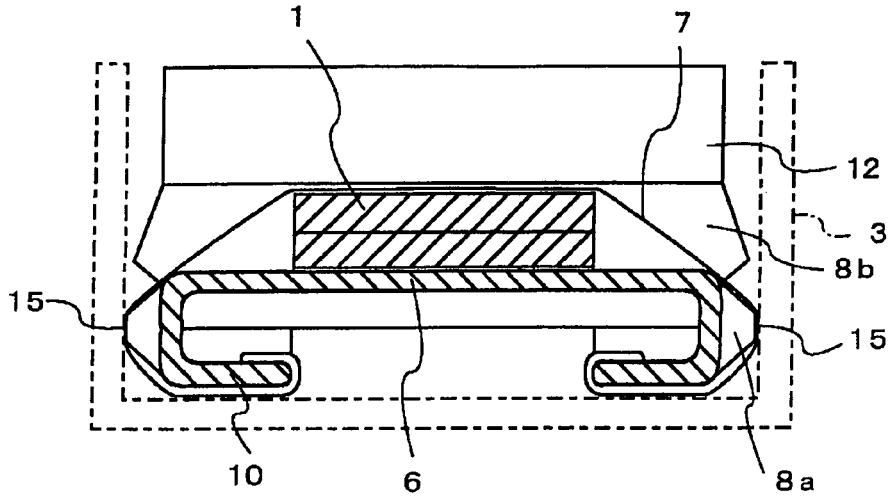
FIG. 10 shows a projecting state of the packing implement in the outer casing, which is a view of the packing implement viewed in the arrow direction from line E-E in FIG. 9(*c*).
Figure 11:
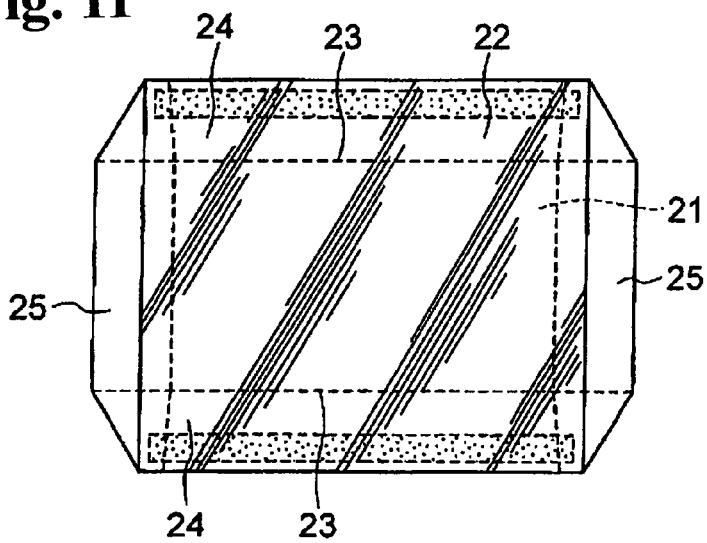
FIG. 11 is a developed view showing an example of conventional packaging structures for goods transportation.
Figure 12:
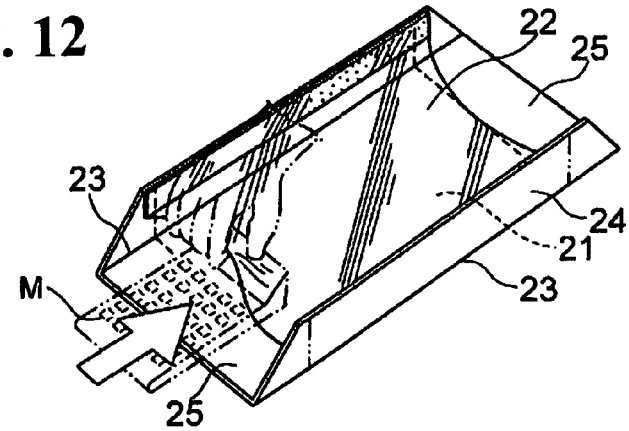
FIG. 12 is a view showing a step for housing the article in the packaging structure shown in FIG. 11.
Figure 13:
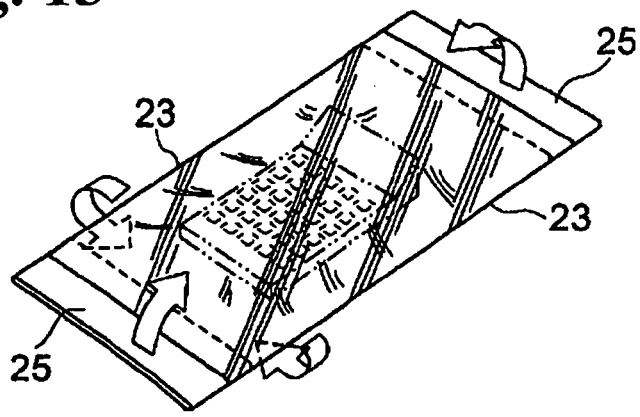
FIG. 13 is a view showing a step for bending a part of a baseboard and tensing a holding sheet.
Figure 14:
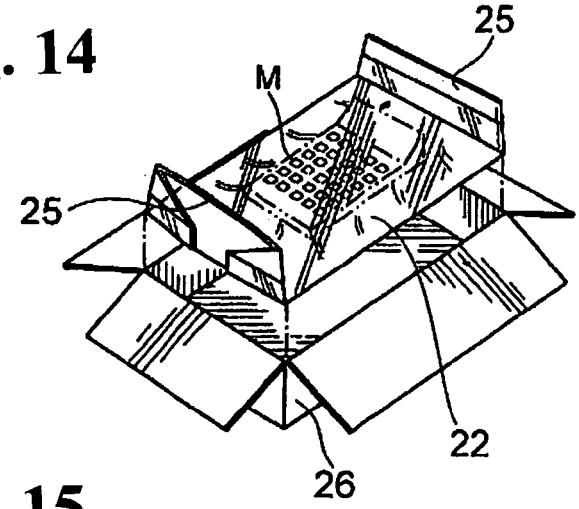
FIG. 14 is a view showing a step for housing the packaging structure holding the article in a transportation casing.
Figure 15:
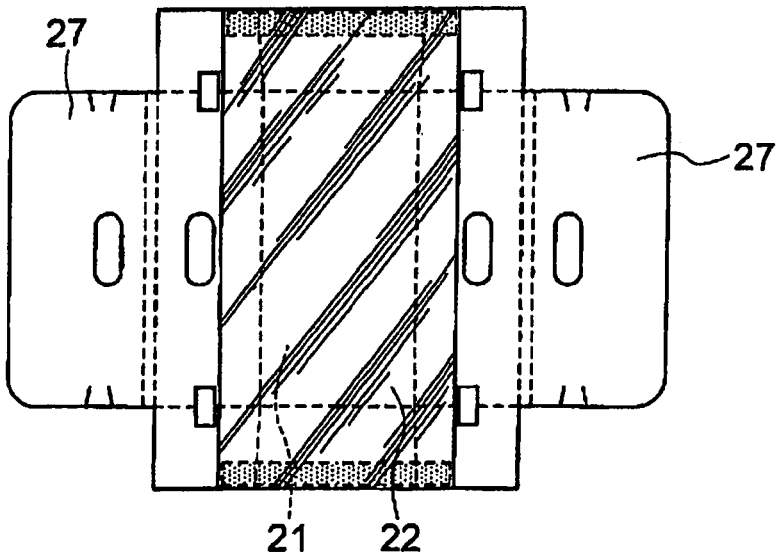
FIG. 15 is a developed view showing another example of conventional packaging structures for goods transportation.
Figure 16:
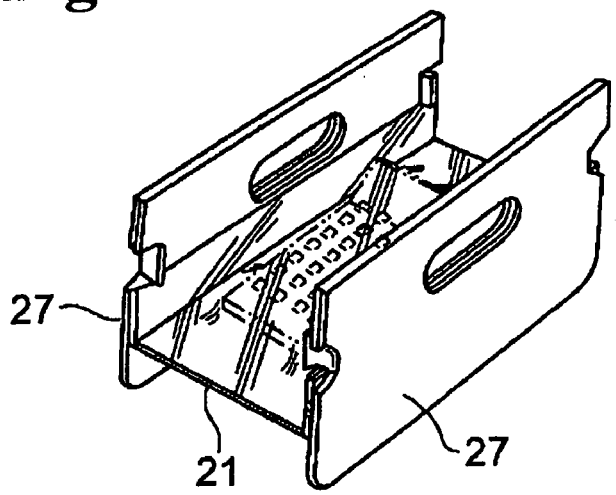
FIG. 16 is a view showing an assembled state when making the packaging structure in FIG. 15 hold the article and housing the packaging structure in a transportation casing.
Figure 17:
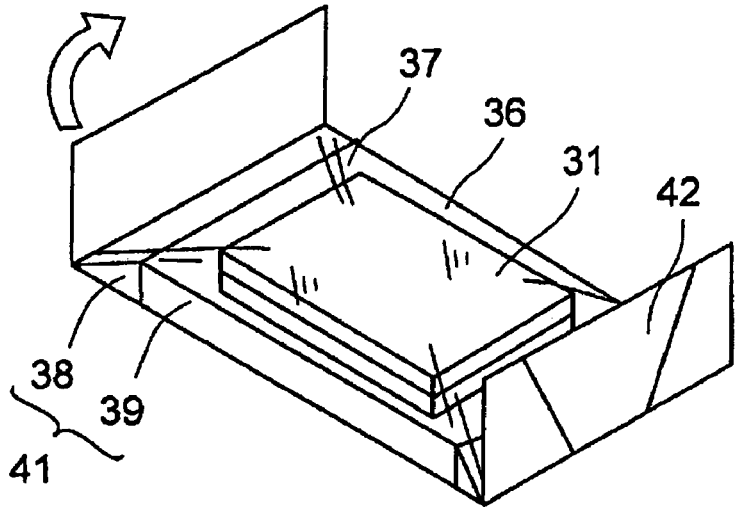
FIG. 17(*a*) is a perspective view of a packing implement (1) previously proposed, and FIG. 17(*b*) is a longitudinal sectional view of FIG. 17(*a*).
Figure 17:
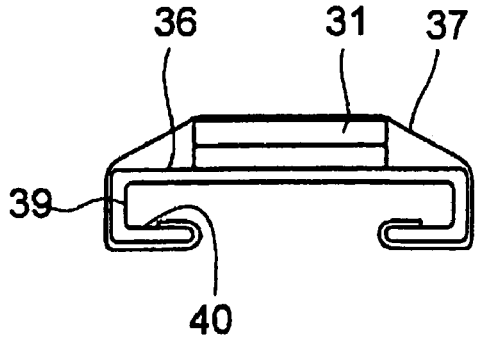
Figure 18:
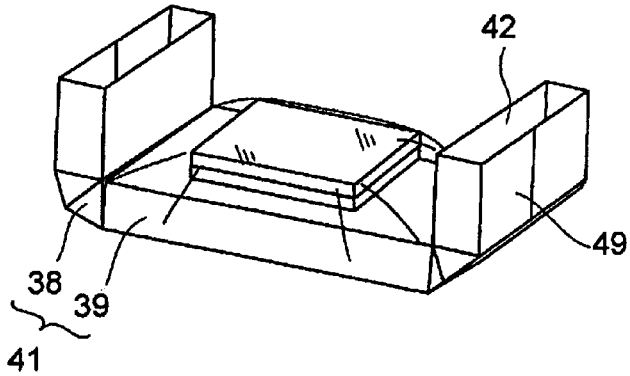
FIG. 18 is a view showing a packing implement (2) formed at a rising part of which with a casing body by applying the packing implement (1).
Figure 19:
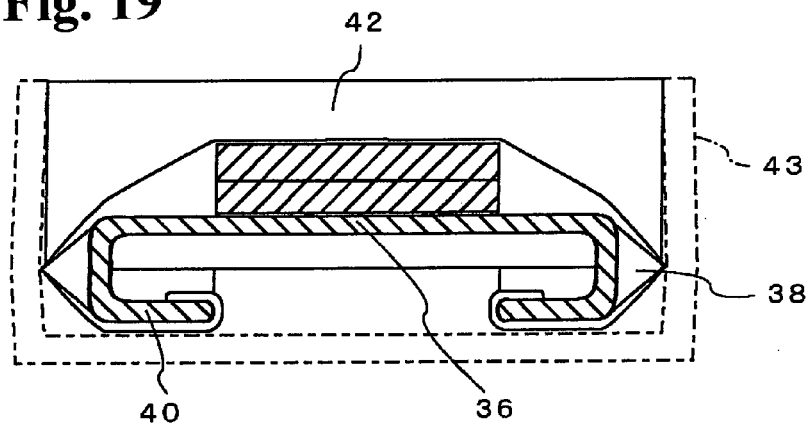
FIG. 19(*a*) is a view showing a problem in the packing implement (1), and FIG. 19(*b*) is a view showing a problem in the packing implement (2).
Figure 19:
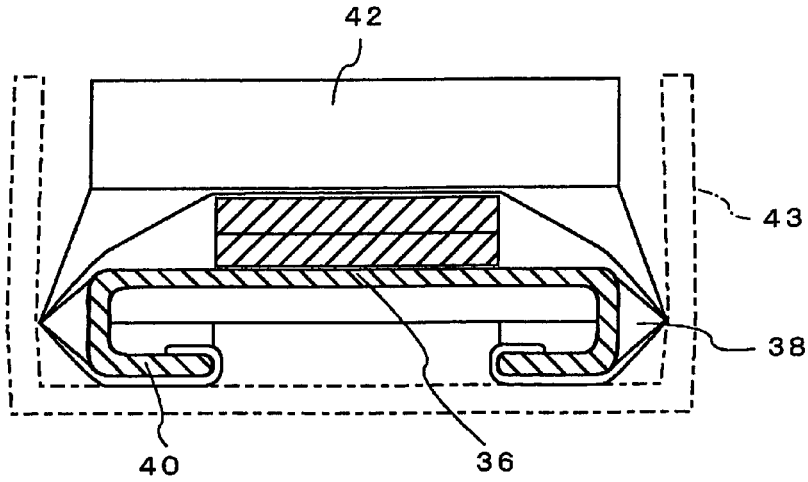

Moreover, the triangle parts 8*a*, 8*b* both become flat surfaces absent at their tips. Accordingly, when the packing implement that has housed an article is accommodated in an outer casing, the triangle parts 8*a*, 8*b* projected to the sides from the leg part 9 and the rising part 12 as shown in FIG. 10 are absent at their tips to have flat end surfaces, respectively, and thus never damage the inner surfaces of the outer casing 3 facing these. For example, a wiring cord or other components of the notebook computer can be housed in the casing body formed at the rising part. The casing body of the shape retaining part 16 formed at the rising part 12 is not limited to housing components, and can also be used as a spacer to separate an upper packing implement from a lower packing implement when the packing implements are stacked up more than two tiers and housed in the outer casing 3.

In this embodiment as well, not only can an oblong slit be opened in the rising part as in the previous embodiment and used as a handle for holding of the packing implement, but when the end of the holding sheet is fixed to the outer surface of the rising part through the slit and another end of the holding sheet is attachably or detachably fixed to another opposite rising part, four sides of the holding sheet can also be fixed after the article is packed.

As a matter of course, the present invention is applicable to not only a packing implement for transportation of notebook computers but a packing implement for transportation of electronics devices the same as the notebook computer or fragile articles such as tableware. Additionally, a state of the packed article can be made see through from the outside with use of a transparent holding sheet. The packing implement for transportation of the present invention is extremely effective for transportation of goods, more particularly, as a packing implement for home delivery service.

The invention claimed is:

1. A packing implement for goods transportation comprising:

a baseboard and a holding sheet adapted for storing an article in an outer casing, wherein:

the baseboard is a rectangular board for supporting the article to be transported at a fixed position, the baseboard including:

a center part, the center part having parallel first sides and parallel second sides, and wherein:

the baseboard has folding parts demarked by fold lines marked on an upper surface of the base board at both ends and both side parts of the center part of the base board, respectively;

the folding parts include rising parts, falling parts, and shape retaining parts;

the rising parts comprise parts folded upward from both end edges of the second side of the baseboard and the falling parts comprise parts folded back downward from both side edges of the first side of the baseboard respectively, each falling part has a free edge to which the holding sheet is secured so that downward folding of the falling parts draws the holding sheet taut across the upper surface of the center part, and is constituted by a leg part orthogonal to the center part and a bottom part which is bent parallel with the center part, and a buffer space corresponding to a rising height of the leg part of the falling part, is formed by the leg part bent so as to be orthogonal to the center part and the bottom part bent parallel with the center part;

both ends of the leg part are at acute angles and contiguous with the rising parts, respectively, both end parts of the baseboard being contiguous with the rising parts are wider than a center part of the baseboard, respectively, triangular parts of both ends of the leg parts are projected to side of the baseboard, respectively, and buffer spaces are formed below a lower surface of the center part, when the falling parts are folded downward and the rising parts are folded back upward, respectively;

the shape retaining parts comprise four corner parts which remain between end edges of the rising parts and end edges of the falling parts, respectively, which are contiguous with the rising parts and the falling parts, respectively, are folded parallel with the rising parts when the falling parts are bent downwardly, respectively, and are erected to hold the falling parts bent when the rising parts are folded upwards, respectively, and polygonal openings are formed in the base board, each polygonal opening being located at a front end of the triangle part of the end of the leg part where the fold lines for the rising part, the falling part, and the shape retaining part, join, each polygonal opening having each of its vertices intersectively coincident with a fold line, and each polygonal opening serves as a starting point when folding the baseboard to prevent the folding parts from deviating from the fold lines, and after folding, eliminates a pointed portion to prevent the outer casing from damage.

2. A packing implement for goods transportation comprising:

a rectangular baseboard for supporting an article to be transported at a fixed position thereon, the baseboard including:

a center part having parallel first sides and parallel second sides, and folding parts comprising:

falling parts respectively provided outside the center part at the first sides, the falling parts each having a free edge, rising parts respectively provided outside the center part at the second sides, and shape retaining parts provided at corners of the baseboard each connecting a falling part and an adjacent rising part, and wherein:

the rising parts, the falling parts, and the shape retaining parts are respectively demarked from the center part by fold lines on the baseboard;

the rising parts are parts folded upward from both end edges of the second sides of the center part, and the falling parts are parts folded downward from both side edges of the first sides of the center part, respectively, each falling part is constituted by a leg part orthogonal to the center part and a bottom part which is bent parallel with the center part, and a buffer space formed by the leg part bent so as to be orthogonal to the center part and the bottom part bent parallel with the baseboard;

both ends of the leg part are at acute angles and contiguous with the rising parts, respectively, both end parts of the baseboard which are contiguous with the rising parts are wider than the center part of the baseboard, respectively, and triangular parts of both ends of the leg parts are projected to a side of the center part, respectively, and buffer spaces are formed below the center part, respectively, when the falling parts are folded downward and the rising parts are folded upward, respectively;

the shape retaining parts comprise four corner parts of the baseboard remaining between end edges of the rising parts and end edges of the falling parts, respectively, which are contiguous with the rising parts and the falling parts, respectively, which are folded parallel with the rising parts when the end edges of the falling parts are bent to a lower surface of the center part, respectively, and are erected to hold the falling parts in position when the rising parts are folded upward, respectively; and polygonal openings each formed in the base board at a front end of a triangular part of the end of the leg part where the fold lines for the rising part, the falling part, and the shape retaining part join, each polygonal opening having its vertices at positions of the fold lines, respectively.

3. A packing implement for goods transportation according to claim 2, wherein the polygonal openings each comprise a pentagonal opening and at a front end of the respective triangular parts, five of the fold lines each intersect with a vertex of the polygonal opening.

4. A packing implement for goods transportation according to claim 2, wherein the polygonal openings each comprises a hexagonal opening, the shape retaining parts formed at both the ends of the rising parts each form a casing body of which an upper surface is opened, and at a front end of the respective triangular part, six fold lines each intersect with a vertex of the hexagonal opening.

5. A packing implement for goods transportation according to claim 1, wherein the polygonal opening comprises a pentagonal opening and at a front end of the respective triangular parts, and five of the fold lines respectively intersect with a vertex of the polygonal opening.

6. A packing implement for goods transportation according to claim 2, wherein the polygonal opening comprises a hexagonal opening, the shape retaining parts formed at both the ends of the rising parts each form a casing body of which an upper surface is opened, and at a front end of the respective triangular part, six fold lines respectively intersect with a vertex of the hexagonal opening.

7. A packing implement for packing an article for goods transportation, comprising:

a baseboard for supporting the article, said baseboard including a center part having parallel first sides and parallel second sides, falling parts provided outside the center part at the first sides, rising parts provided outside the center part at the second sides, and shape retaining parts provided on corners of the baseboard each connecting the falling part and the rising part adjacent thereto, and a holding sheet provided on the baseboard for covering the article and having at least two sides fixed to end edges of the falling parts, wherein the falling parts are configured to be folded downward from the first side of the center part, each of the falling parts having a leg part orthogonal to the center part and a bottom part parallel with the center part for forming a buffer space corresponding to a height of the leg part relative to the center part when folded, the rising parts are configured to be folded upward from the second sides of the center part, each of the shape retaining parts is configured to be folded back so as to be parallel with the rising part when the falling part is folded back toward a lower surface of the center part, and integrally erected with the rising parts while contacting with a lower surfaces of the rising parts when the rising part is folded upward, the baseboard has polygonal openings at intersections of the first and second sides of the center part so as to fold upward the rising part easily, each polygonal opening being located at a front end of a triangle part of an end of the leg part where fold lines for the rising part, the falling part, and the shape retaining part, join, each polygonal opening being located at vertices intersectively coincident with the fold lines, when the rising part is held upward, an erection state of the shape retaining part is kept, the leg part of the falling part is kept orthogonal to the center part, and the bottom part is kept parallel with the center part, and the holding sheet is tensed by folding downward the falling part thereby pressing the article to the center part and holding the article at the fixed position.

* * * * *